US010827818B2

(12) United States Patent
Martinek et al.

(10) Patent No.: US 10,827,818 B2
(45) Date of Patent: Nov. 10, 2020

(54) LIPSTICK REMOVAL DEVICE

(71) Applicants: Katey Elizabeth Martinek, Kalamazoo, MI (US); Celine Terry, Miami Shores, FL (US)

(72) Inventors: Katey Elizabeth Martinek, Kalamazoo, MI (US); Celine Terry, Miami Shores, FL (US)

( * ) Notice: Subject to any disclaimer, the term of this patent is extended or adjusted under 35 U.S.C. 154(b) by 230 days.

(21) Appl. No.: 15/935,921

(22) Filed: Mar. 26, 2018

(65) Prior Publication Data

US 2019/0289985 A1 Sep. 26, 2019

Related U.S. Application Data

(63) Continuation-in-part of application No. 29/641,903, filed on Mar. 26, 2018, now Pat. No. Des. 854,239.

(51) Int. Cl.
*A45D 44/00* (2006.01)

(52) U.S. Cl.
CPC ..... *A45D 44/00* (2013.01)

(58) Field of Classification Search
CPC . A45D 40/30; A45D 40/28; A45D 2200/1063
See application file for complete search history.

(56) References Cited

U.S. PATENT DOCUMENTS

| | | | | | |
|---|---|---|---|---|---|
| 2,002,144 | A * | 5/1935 | Heaton | A45D 40/28 | 132/320 |
| 5,221,153 | A * | 6/1993 | Spatz | A45D 40/0087 | 132/320 |
| 5,285,799 | A * | 2/1994 | Minard | A45D 40/26 | 132/200 |
| 6,070,598 | A * | 6/2000 | Gueret | A45D 40/267 | 132/317 |
| 6,076,534 | A * | 6/2000 | Gueret | A45D 40/26 | 132/317 |
| 6,526,992 | B2 * | 3/2003 | Bouix | A45D 40/0087 | 132/317 |
| 2007/0020027 | A1 * | 1/2007 | Gueret | A45D 40/262 | 401/130 |
| 2008/0152419 | A1 * | 6/2008 | Hartstock | A45D 40/267 | 401/121 |
| 2012/0312315 | A1 * | 12/2012 | Gueret | A45D 34/045 | 132/200 |

* cited by examiner

*Primary Examiner* — Rachel R Steitz
*Assistant Examiner* — Brianne E Kalach
(74) *Attorney, Agent, or Firm* — Mark Terry

(57) ABSTRACT

A device for removing lipstick includes a shaft having a proximal end coupled to a base, wherein the shaft is configured to fit within a person's mouth, a détente that extends around an entire circumference of the shaft, a concave surface with rounded edges on a distal end of the shaft, wherein the concave surface is configured for blending lipstick, and a cap that is configured to fit securely around the shaft. A method for removing lipstick comprises includes inserting the shaft of the device into the mouth, closing the lips over the détente in the shaft, and then pulling the shaft out of the mouth, while the lips drag over the surface of the shaft.

10 Claims, 6 Drawing Sheets

LIPSTICK REMOVAL DEVICE

CROSS-REFERENCE TO RELATED APPLICATIONS

This application is a continuation in part of, and claims priority to, patent application Ser. No. 29/641,903 filed Mar. 26, 2018 entitled "Lipstick Removal Device." The subject matter of patent application Ser. No. 29/641,903 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The technical field relates generally to cosmetics and, more specifically, to devices that facilitate the application of cosmetics.

BACKGROUND

Lipstick is a cosmetic product containing pigments, oils, waxes, and emollients that apply color, texture, and protection to the lips. Available in a large assortment of types and colors, lipstick is typically worn by women across a wide variety of cultures, countries, socioeconomic classes and ages. One well researched psycho-sociological theory behind the use of lipstick is that by embellishing the color of the lips, a woman is subconsciously echoing the color of her vaginal lips, or labia, in an effort to attract attention from men.

A common problem associated with applying lipstick to the lips involves the unintentional application of lipstick to the front teeth. When lipstick is applied to the lips, a small amount of lipstick often ends up on the inside surface of the upper or lower lips, which happen to rest on the front teeth. Therefore, when lipstick-covered lips rest upon the front teeth, the front teeth can become smeared with lipstick. Consequently, lipstick is often inadvertently transferred to the front teeth, which can be unsightly and unattractive.

Therefore, a need exists for improvements over the prior art, and more particularly for more efficient methods and systems for applying lipstick correctly and precisely.

SUMMARY

A device and method for removing lipstick is provided. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a device for removing lipstick comprises a shaft having a proximal end coupled to a base, wherein the shaft is comprised of silicone rubber, and wherein the shaft is configured to fit within a person's mouth, a détente that extends around an entire circumference of the shaft, a concave surface with rounded edges on a distal end of the shaft, wherein the concave surface is configured for blending lipstick, and a cap that is configured to fit securely around the shaft.

In another embodiment, a method for removing lipstick comprises utilizing a device that includes shaft having a proximal end coupled to a base, wherein the shaft is comprised of silicone rubber, and wherein the shaft is configured to fit within a person's mouth, a détente that extends around an entire circumference of the shaft, a concave surface with rounded edges on a distal end of the shaft, wherein the concave surface is configured for blending lipstick, and a cap that is configured to fit securely around the shaft. The method includes inserting the shaft of the device into the mouth, closing the lips over the détente in the shaft, and then pulling the shaft out of the mouth, while the lips drag over the surface of the shaft.

BRIEF DESCRIPTION OF THE DRAWINGS

The accompanying drawings, which are incorporated in and constitute a part of this disclosure, illustrate various example embodiments. In the drawings.

DETAILED DESCRIPTION

Figure 1:
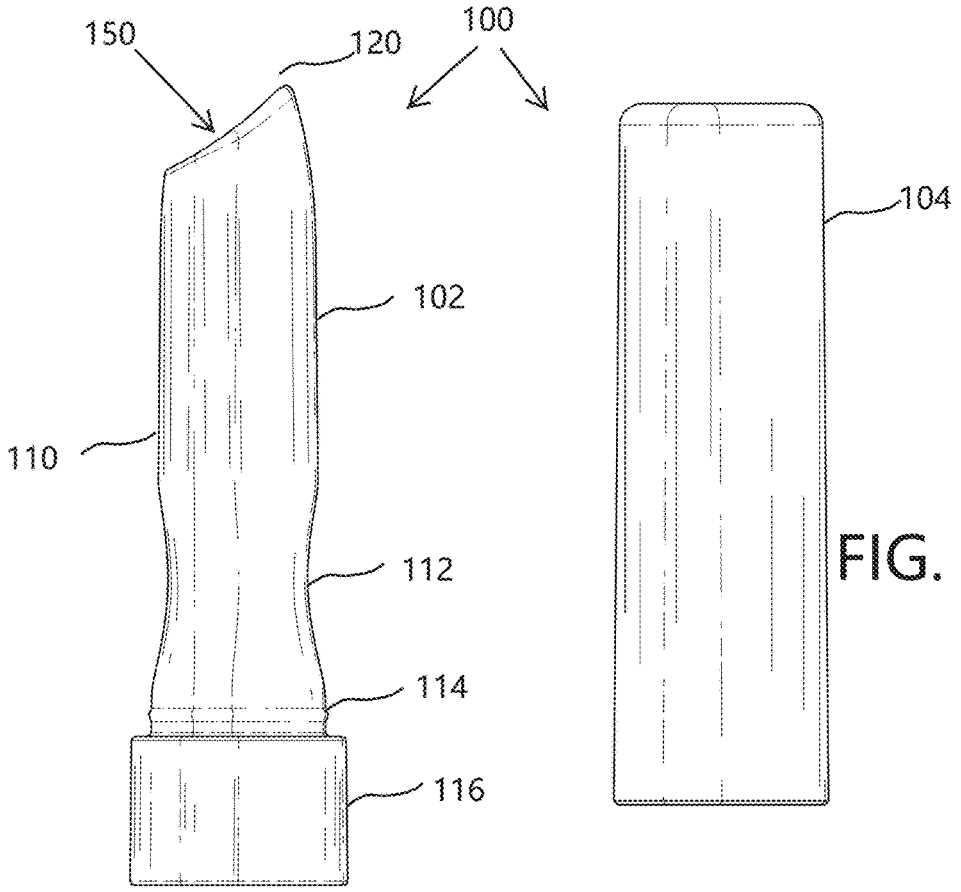
FIG. 1 is a drawing showing a left view of the device for removing lipstick, in a disassembled state, according to an example embodiment.

The following detailed description refers to the accompanying drawings. Wherever possible, the same reference numbers are used in the drawings and the following description to refer to the same or similar elements. While embodiments of the claimed subject matter may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The claimed embodiments improve over the prior art by providing an efficient, and precise way of removing lipstick from the inside surface of the lips, so as to reduce or eliminate the inadvertent transfer of lipstick to the surface of the teeth. The example embodiments leverage the device for removing lipstick from the inside surface of the lips, by also providing an additional feature—a lipstick blending element. The disclosed embodiments provide a small, compact, light, and easy to carry device that both eliminates the application of lipstick to teeth and also can be used to blend lipstick on the lips. The features of the claimed subject matter allow for the quick, efficient and easy application of lipstick in a precise way.

FIG. 1 is a drawing showing a left view of the device 100 for removing lipstick, in a disassembled state, according to an example embodiment. The device 100 is shown to comprise a handheld tool element 102 and a cap element 104. The tool 102 comprises a shaft 110 with a base 116, which is configured for optimal handling by a human hand. The shaft includes a détente or dip 112 closer to the proximal end than the distal end, wherein the détente 112 extends around the entire circumference of the shaft 110. The détente or dip is an area extending around the shaft, which the détente or dip has an outer diameter smaller than the outer diameter of the rest of the shaft. In one embodiment the détente or dip extends only partially around the shaft. The size, shape, length, width, circumference, and depth of the shaft is configured to fit within a person's mouth. The shaft may be about 1 to 4 inches long, and about 0.5 to 1.5 inches thick.

The shaft further includes a raised ring 114 that extends around the entire circumference of the shaft, wherein the raised ring is configured to hold the cap element 104 in place when the device 100 is assembled. The distal end of the shaft culminates in a rounded tip 120 that is adjacent to a concave surface 150. The shaft 110, the base 116, or the entire tool 102 may be composed of a silicone rubber configured for removing lipstick from skin when the device is rubbed against lipstick-laden skin on the lips. Alternative to silicone rubber, the shaft 110, the base 116, or the entire tool 102 may be composed of one or more of: vulcanized rubber, PVC, EPDM rubber, styrene-butadiene rubber, natural rubber, latex, synthetic rubber, neoprene, plastic, a polymer, an elastomer, thermoplastic, thermosetting polymer, or thermoplastic elastomer. The composition of the shaft 110, the base 116, or the entire tool 102 may comprise a substance with a texture or a friction characteristic that facilitates the removal of lipstick from the lips of a user, when said substance rubs or drags against the surface of the lipstick-laden lips. The shaft 110 and the base 116 may comprise a single, integrated piece that is molded from a single mold, or the shaft 110 and the base 116 may be molded separately and then coupled during manufacture.

Figure 2:
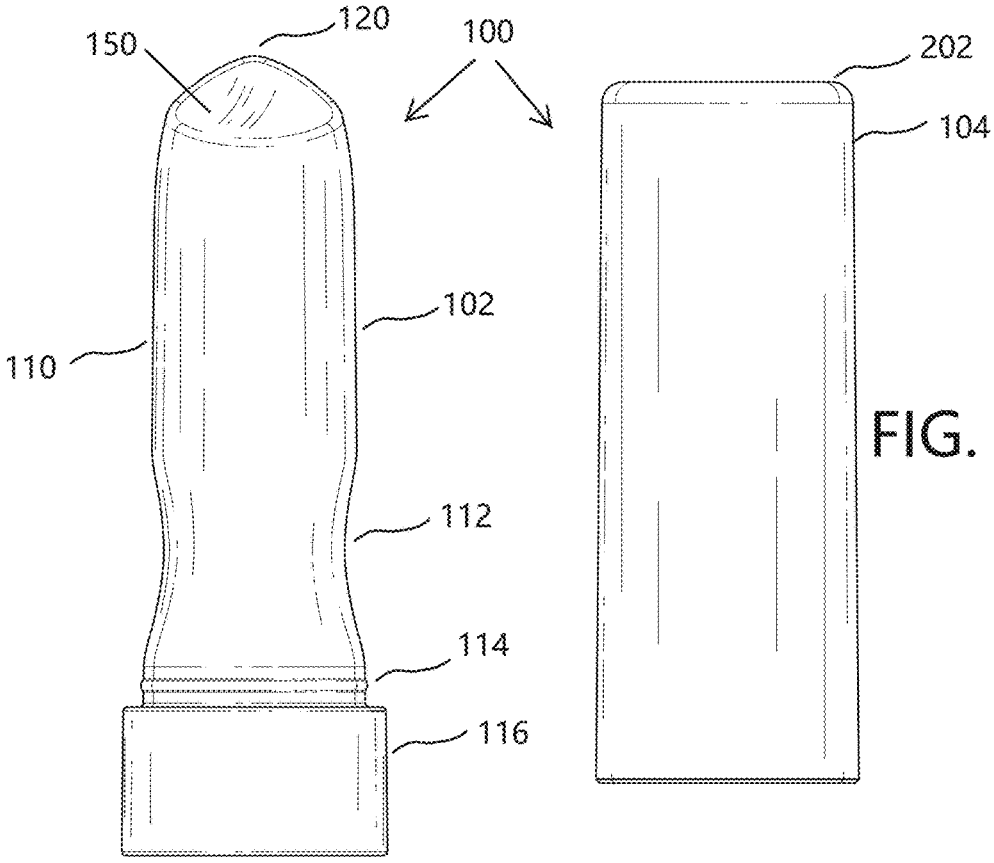
FIG. 2 is a drawing showing a front view of the device for removing lipstick, in a disassembled state, according to an example embodiment.

FIG. 2 is a drawing showing a front view of the device 100 for removing lipstick, in a disassembled state, according to an example embodiment. FIG. 2 shows that the concave surface 150, when viewed from the front view, holds a roughly triangular shape with rounded corners, while the tip 120 also has rounded corners. Since surface 150 is concave, the edges of the triangular shape of the surface 150 have sloping sides that slope downwards. FIG. 2 also shows that the top of the cap element 104 has rounded edges 202 as well.

The roughly triangular outer shape of the concave surface 150 is significant because the device 102 is configured to be gripped by lips that are brought together, and when the lips come together to grip an item, the lips come together to form a triangular shaped cavity. Therefore, the triangular outer shape of the concave surface 150 accommodates lips gripping the device 102 during use.

Figure 3:
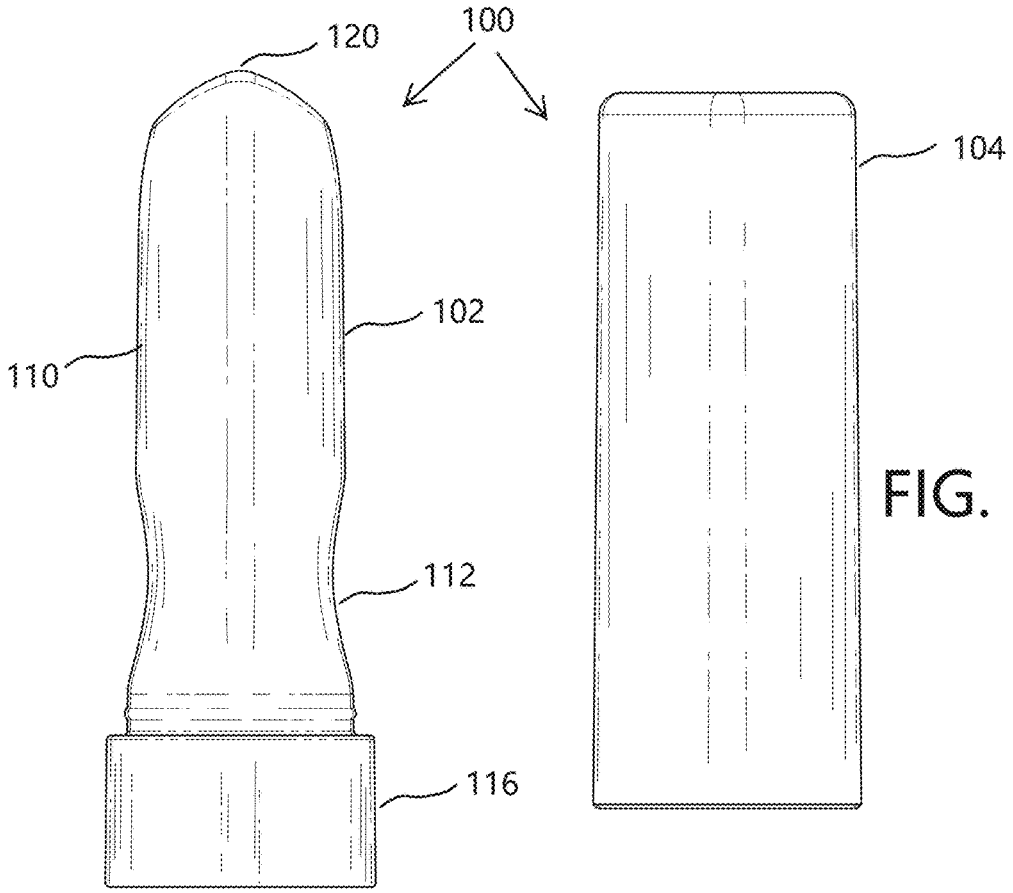
FIG. 3 is a drawing showing a rear view of the device for removing lipstick, in a disassembled state, according to an example embodiment.

FIG. 3 is a drawing showing a rear view of the device 100 for removing lipstick, in a disassembled state, according to an example embodiment. FIG. 3 shows that détente or dip 112 extends around the entire circumference of the shaft 110. FIG. 3 also shows that the shaft culminates at a rounded tip 120.

Figure 4:
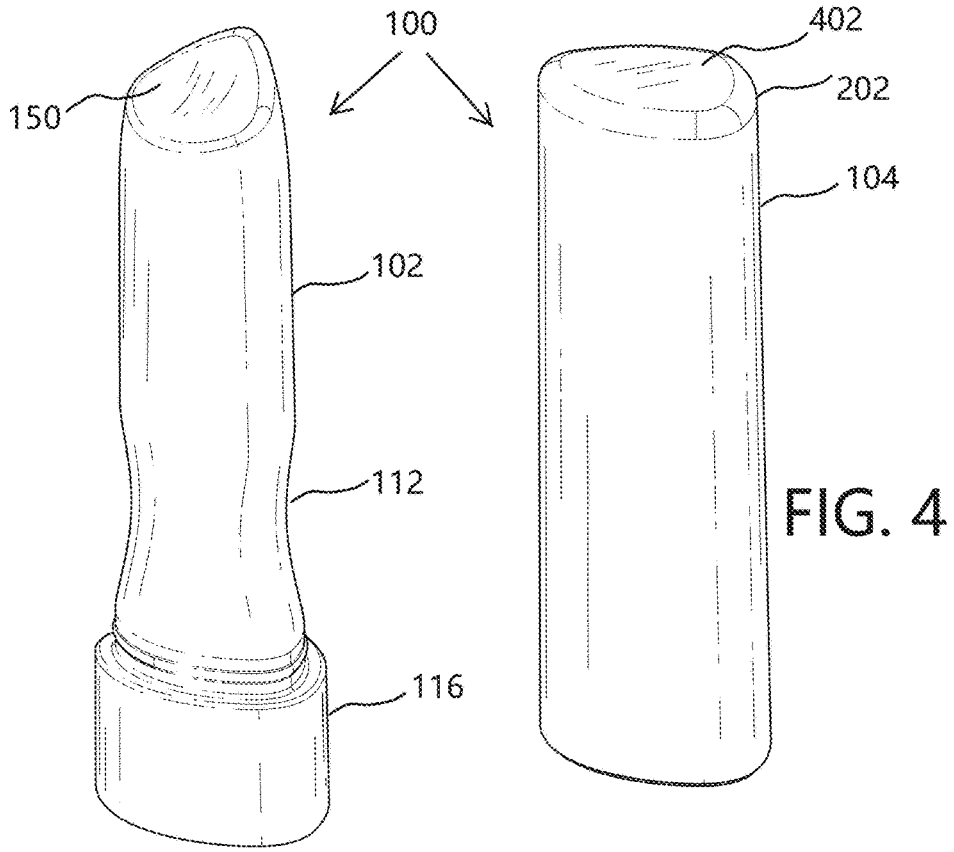
FIG. 4 is a drawing showing a side perspective view of the device for removing lipstick, in a disassembled state, according to an example embodiment.

FIG. 4 is a drawing showing a side perspective view of the device 100 for removing lipstick, in a disassembled state, according to an example embodiment. FIG. 4 shows that the concave surface 150, when viewed from the side perspective view, holds a roughly triangular outer shape with rounded corners, while the tip 120 also has rounded corners. The concave surface 150 resembles a saucer or plate in that it has a circumferential border and a concave inner surface. The concave nature of surface 150, and the sloping sides of the triangular shape of the surface 150, allow for the features of the surface 150 and tip 120 to be used as a lipstick blender. A lipstick blender is a tool that is used to smear, touch-up and otherwise craft lipstick already on a user's lips, normally around it edges, so as to blend it in with the surrounding skin. When applying lipstick, it is desirable to avoid hard lines that delineate where lipstick has and has not been applied. By using the lipstick blender tool embedded in device 100, a user can blend lipstick along the edges of its application on a user's lips, so as to reduce or eliminate the hard lines that delineate where lipstick has and has not been applied on the user's skin.

The concave surface 150 has a principal axis that comprises a straight line that is perpendicular to the curve or bulge in the concave surface. I.e., the principal axis is the line perpendicular to the concave surface and passing through the focus or center of the concave surface. The principal axis is angled at about 45 degrees from the longitudinal axis of the shaft. The longitudinal axis of the shaft is a line that extends through the center of the cylindrical shape of the shaft. FIG. 14 shows the longitudinal axis 1450 of the shaft and the principal axis 1452 of the concave surface, wherein the principal axis 1452 is angled at about 45 degrees from the longitudinal axis 1450. The 45 degree angle of the concave surface 150 is significant because the device 102 is configured to be gripped by a person and then applied to the lips to utilize the concave surface 150 as a lipstick blender. The person is naturally inclined to hold the device 102 such that the longitudinal axis 1450 of the shaft 110 is at a 45 degree angle to the floor or ground. See FIG. 13, which shows a person holding the device 102 at a 45 degree angle to the ground. When the device 102 is held at a 45 degree angle to the ground, the principal axis 1452 is at a 0 degree angle to the person's face, i.e., the principal axis points directly at the person's face and the concave surface 150 is parallel to the person's face. This position allows for a greater surface area of the concave surface 150 to contact the person's lips, therefore optimizing the effect of applying the concave surface to the person's lips to blend lipstick. That is, this position optimizes the lipstick blending capabilities of the device 102. Therefore, the 45 degree angle of the concave surface 150 enhances the lipstick blending capabilities of the device.

Figure 5:
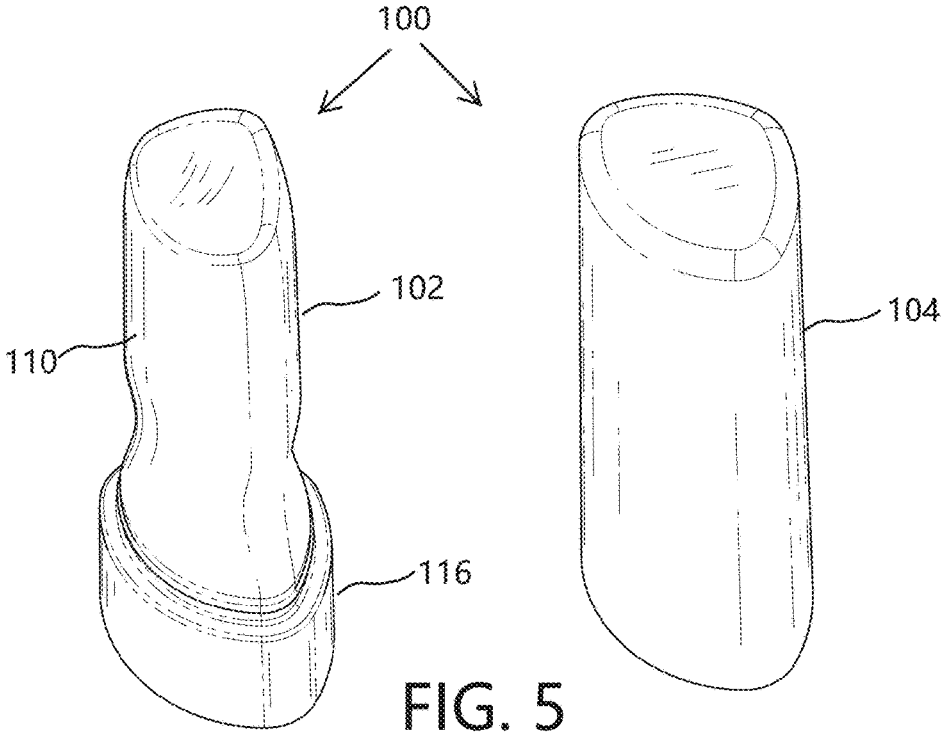
FIG. 5 is a drawing showing a top perspective view of the device for removing lipstick, in a disassembled state, according to an example embodiment.

FIG. 5 is a drawing showing a top perspective view of the device 100 for removing lipstick, in a disassembled state, according to an example embodiment. FIG. 5 shows the roughly triangular outer shape of the base 116, which accommodates the use of three fingers (the thumb, forefinger and middle finger) to hold the device 102 during use. The triangular outer shape of the base 116 is significant because the device 102 is configured to be held by three fingers of the user's hand (namely, the thumb, middle finger and index finger), and when the three fingers come together to grip an item, the three fingers come together to form a triangular shaped cavity. Therefore, the triangular outer shape of the base 116 accommodates the use of said three fingers to hold the device 102 during use.

Figure 6:
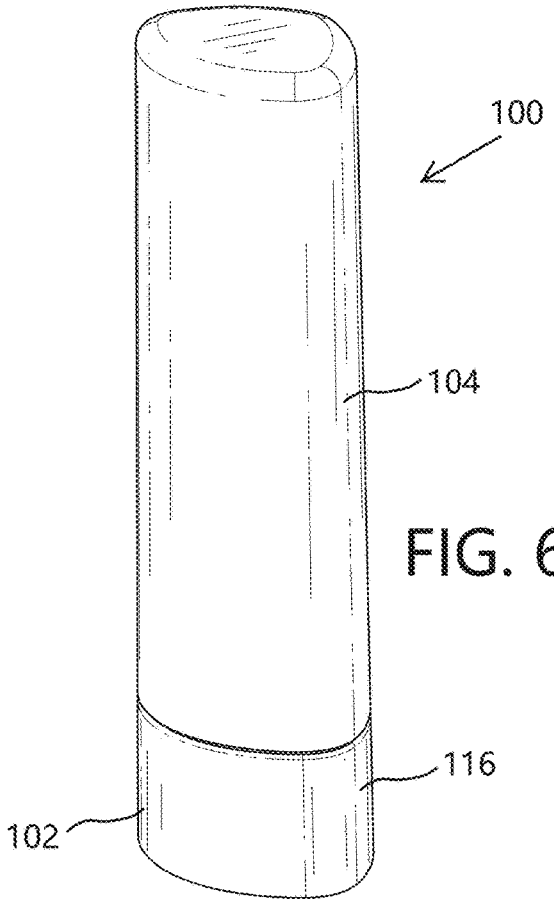
FIG. 6 is a drawing showing a front perspective view of the device for removing lipstick, in an assembled state, according to an example embodiment.

FIG. 6 is a drawing showing a front perspective view of the device 100 for removing lipstick, in an assembled state, according to an example embodiment. FIG. 6 shows that the cap element 104 has been placed over the shaft 110 of the handheld tool element 102, such that the cap element completely covers the shaft 110. This feature protects the shaft, which enters the user's mouth, from getting dirty or otherwise acquiring debris or other elements from its environment. This feature also protects the surrounding environment from being smeared with lipstick or saliva that may be present on the shaft.

FIG. 6 shows that when the cap element 104 has been placed over the shaft 110 of the handheld tool element 102, such that the cap element completely covers the shaft 110, the cap element 104 is juxtaposed to the base 116 in such a way that the outer surface of the cap element 104 is continuous with the outer surface of the base 116. When the cap element 104 has been placed over the shaft 110 of the handheld tool element 102, the entire device 100 appears to be one, single integrated shaft with a roughly triangular cross section with rounded edges.

Figure 7:
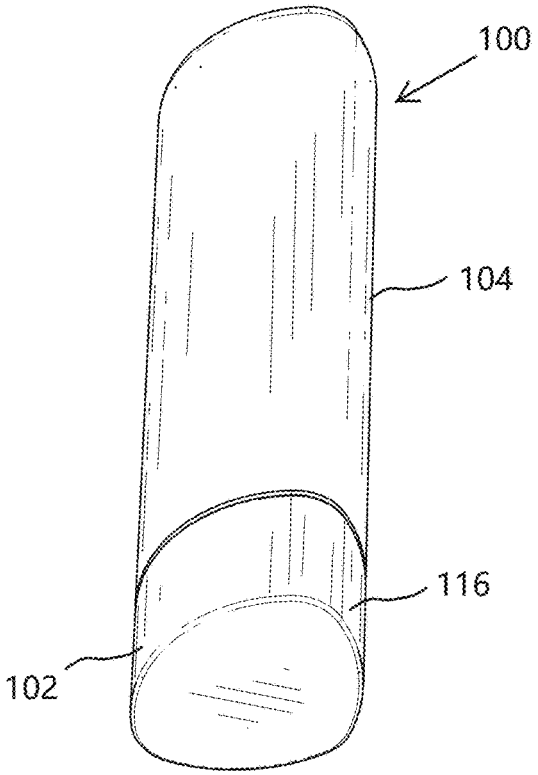
FIG. 7 is a drawing showing a bottom perspective view of the device for removing lipstick, in an assembled state, according to an example embodiment.

FIG. 7 is a drawing showing a bottom perspective view of the device 100 for removing lipstick, in an assembled state, according to an example embodiment. FIG. 7 shows the roughly triangular outer shape of the base 116, which accommodates the use of three fingers to hold the device 102 during use.

Figure 8:
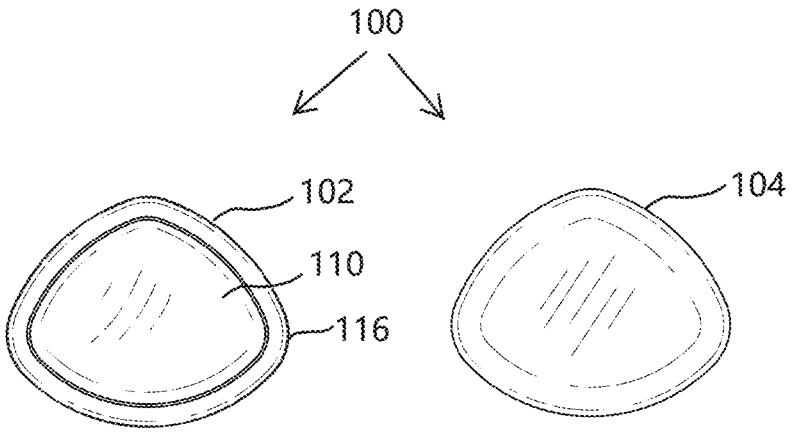
FIG. 8 is a drawing showing a top view of the device for removing lipstick, in a disassembled state, according to an example embodiment.

FIG. 8 is a drawing showing a top view of the device 100 for removing lipstick, in a disassembled state, according to an example embodiment. FIG. 8 shows that the shaft 110 has a footprint (or an outer diameter) that is smaller than the footprint (or outer diameter) for the base 116. FIG. 8 also shows the roughly triangular outer shape of the base 116, as well as the roughly triangular outer shape of the shaft 110. FIG. 8 also shows the size and roughly triangular outer shape of the cap element 104 matches the size and roughly triangular outer shape of the base 116. This feature is due to the fact that when the cap element 104 is placed over the shaft 110 of the handheld tool element 102, the outer surface of the cap element 104 is continuous with the outer surface of the base 116, and the entire device 100 appears to be one, single integrated shaft with a roughly triangular cross section with rounded edges (see FIGS. 6-7).

Figure 9:
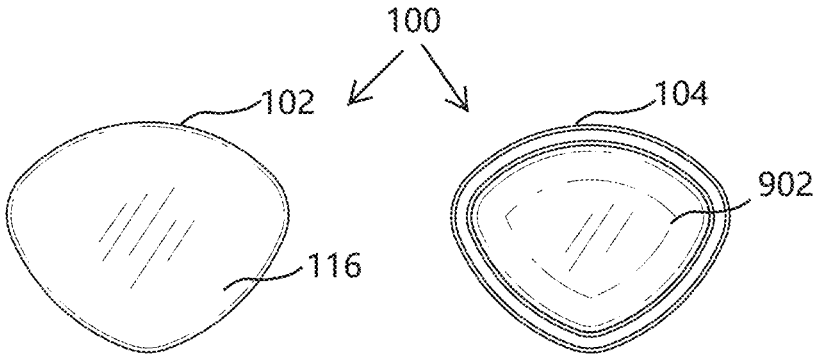
FIG. 9 is a drawing showing a bottom view of the device for removing lipstick, in a disassembled state, according to an example embodiment.

FIG. 9 is a drawing showing a bottom view of the device 100 for removing lipstick, in a disassembled state, according to an example embodiment. FIG. 9 shows that the underside of the cap element 104 has a cavity 902 that has a size and roughly triangular outer shape that matches the size and roughly triangular outer shape of the shaft 110 in FIG. 8. This is because the cavity 902 must accommodate the shaft 110 when the cap element 104 is placed over the shaft 110 of the handheld tool element 102, and the shaft 110 must fit securely with said cavity 902.

Figure 10:
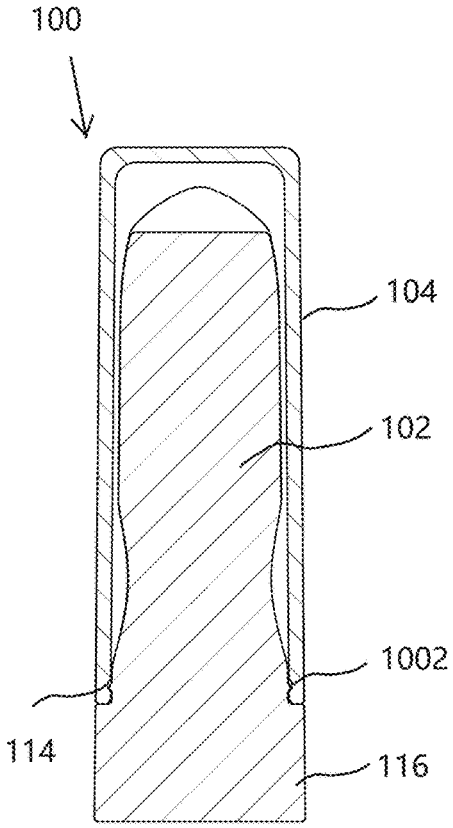
FIG. 10 is a drawing showing a front cross sectional view of the device for removing lipstick, in an assembled state, according to an example embodiment.

FIG. 10 is a drawing showing a front cross sectional view of the device 100 for removing lipstick, in an assembled state, according to an example embodiment. FIG. 10 shows that the outer circumference and surface of the cap element 104 matches the circumference and surface of the base 116. FIG. 10 shows that when the cap element 104 has been placed over the shaft 110 of the handheld tool element 102, such that the cap element completely covers the shaft 110, the cap element 104 is juxtaposed to the base 116 in such a way that the outer surface of the cap element 104 is continuous with the outer surface of the base 116.

FIG. 10 also shows that the inside surface of the cap element 104 includes a gutter or channel 1002 that extends around the inside surface of the cap element 104. The location of the gutter or channel 1002 on the inside surface of the cap element 104 matches the location of the raised ring 114 that extends around the entire circumference of the shaft 110. The raised ring 114 has a size and shape that matches the size and shape of the gutter or channel 1002. When the cap element 104 has been placed over the shaft 110 of the handheld tool element 102, the raised ring 114 is inserted into the gutter or channel 1002, which holds the cap element 104 in place when the device 100 is assembled.

Figure 11:
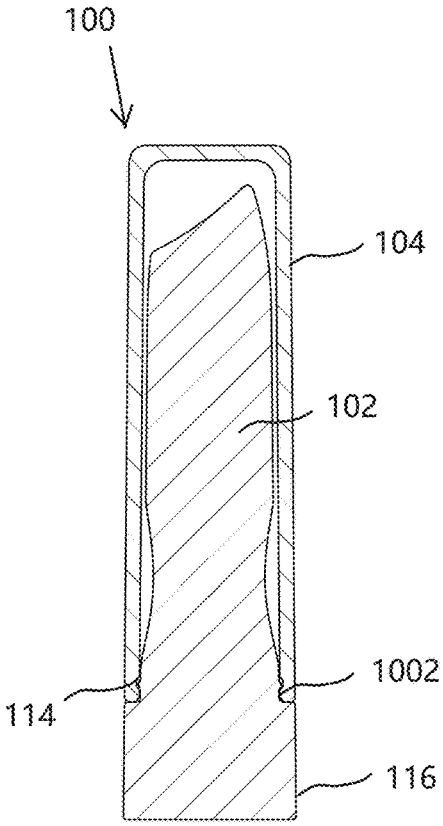
FIG. 11 is a drawing showing a side cross sectional view of the device for removing lipstick, in an assembled state, according to an example embodiment.

FIG. 11 is a drawing showing a side cross sectional view of the device 100 for removing lipstick, in an assembled state, according to an example embodiment. FIG. 11 shows that the outer circumference and surface of the cap element 104 matches the circumference and surface of the base 116.

Figure 12:
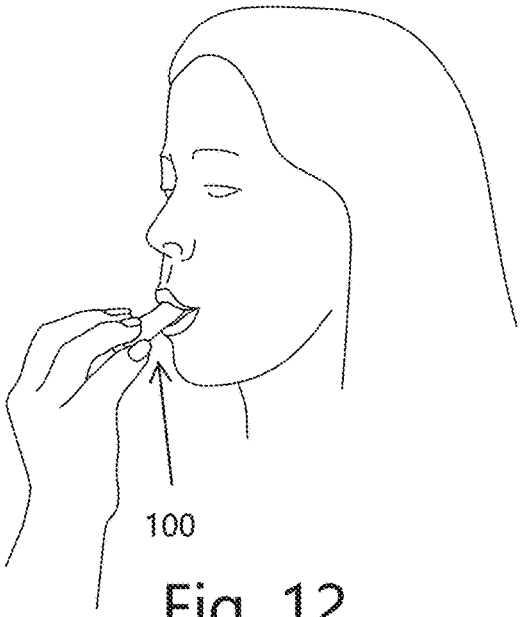
FIG. 12 is a drawing showing a perspective view of a woman utilizing the device for removing lipstick, according to an example embodiment.

FIG. 12 is a drawing showing a perspective view of a woman utilizing the device 100 for removing lipstick, according to an example embodiment. FIG. 12 shows the woman inserts the handheld tool element 102 into her mouth and then completely closes her lips around the détente so as to rest around the détente or dip 112 closer to the proximal end than the distal end of the handheld tool element 102, wherein the détente 112 extends around the entire circumference of the shaft 110. FIG. 12 shows the woman has begun pulling the handheld tool element 102 from her mouth, while her lips are still closed around the shaft 110, in an effort to transfer unwanted lipstick from the inside surface of her lips to the element 102.

Figure 13:
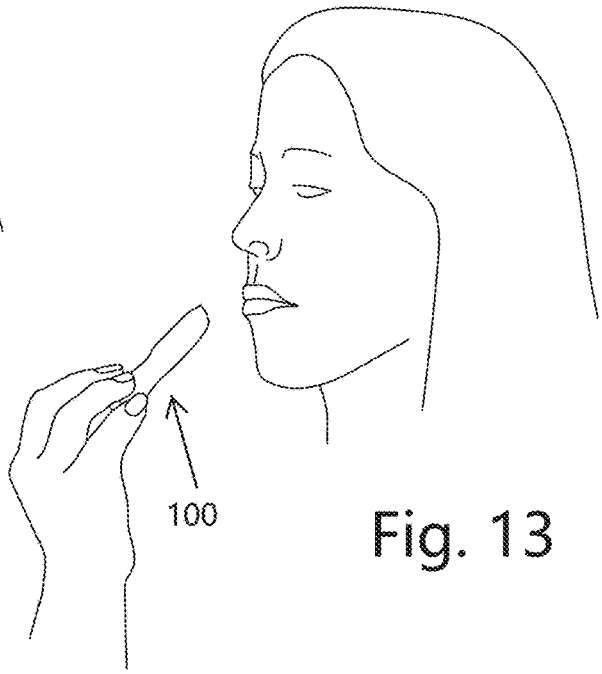
FIG. 13 is a drawing showing a perspective view of a woman utilizing the device for removing lipstick, according to an example embodiment.
Figure 14:
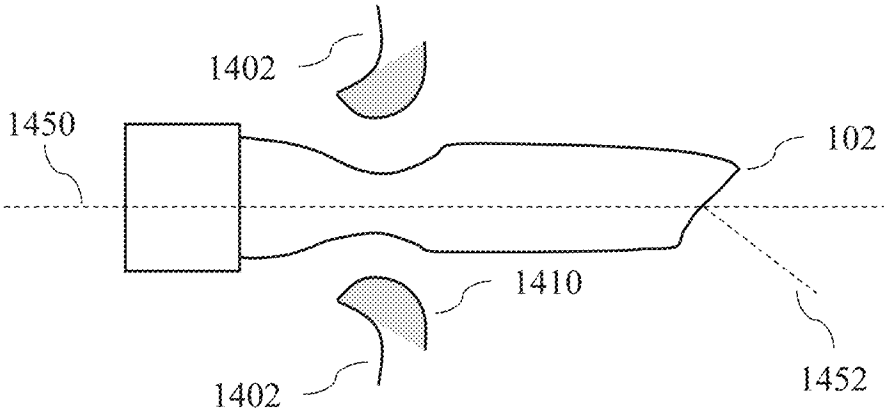
FIG. 14 is a drawing showing a cross sectional view of a person utilizing the device for removing lipstick, according to an example embodiment.

FIG. 13 is a drawing showing another perspective view of the woman utilizing the device 100 for removing lipstick, according to an example embodiment. FIG. 13 shows the woman has completed pulling the handheld tool element 102 from her mouth, which has transferred unwanted lipstick from the inside surface of her lips to the shaft 110, which occurred when the lipstick-laden portion of her lips dragged against the surface of the shaft 110.

FIG. 14 is a drawing showing a cross sectional view of a person utilizing the device 100 for removing lipstick, according to an example embodiment. FIG. 14 shows the handheld tool element 102 inserted into the person's mouth and the lips 1402 hovering over the handheld tool element 102. Lipstick has been applied to the interior surfaces 1410 of the lips 1402. If the lips 1402 were to rest on the person's teeth, the lipstick on the interior surfaces 1410 would be transferred to the teeth, leaving unsightly lipstick on the teeth. FIG. 14 also shows the longitudinal axis 1450 of the shaft and the principal axis 1452 of the concave surface, wherein the principal axis 1452 is angled at about 45 degrees from the longitudinal axis 1450.

Figure 15:
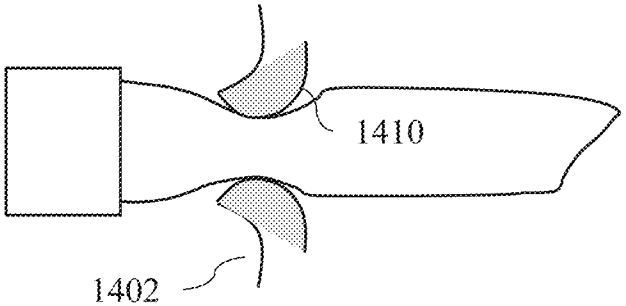
FIG. 15 is a drawing showing a cross sectional view of a person utilizing the device for removing lipstick, according to an example embodiment.

FIG. 15 is a drawing showing another cross sectional view of a person utilizing the device 100 for removing lipstick, according to an example embodiment. FIG. 14 shows lips 1402 now contacting the handheld tool element 102, more specifically, the lips 1402 are resting within the dip or détente 112 that extends around the entire circumference of the shaft 110. Alternatively, the lips 1402 are gripping the shaft 110 at the dip or détente that extends at least partially around the circumference of the shaft.

Figure 16:
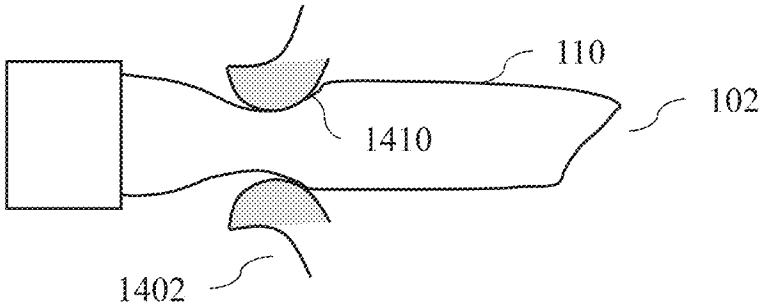
FIG. 16 is a drawing showing a cross sectional view of a person utilizing the device for removing lipstick, according to an example embodiment.

FIG. 16 is a drawing showing another cross sectional view of a person utilizing the device 100 for removing lipstick, according to an example embodiment. FIG. 16 shows the result when the handheld tool element 102 is pulled outwards from the person's mouth, after the position shown in FIG. 15. When the pulling action occurs, the lips 1402 are pulled slightly outwards (in a pout-like or duck-bill-like manner) and the interior surfaces 1410 of the lips 1402 are dragged against the surface of the shaft 110, namely, the surface of the shaft that extends from the dip or détente 112 and towards the distal direction of the shaft. As the interior surfaces 1410 of the lips 1402 are dragged against the surface of the shaft 100, lipstick is transferred from the interior surfaces of the lips to the shaft 100. Ideally, after the device 100 has been removed from the person's mouth, all of the lipstick on the interior surfaces 1410 of the lips has been removed. Subsequently, if lips were to rest on the teeth, lipstick would not be transferred to the teeth.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A device for removing lipstick, comprising:

a base having a substantially triangular outer shape;

a shaft extending along a central axis between a first and a second end, the shaft directly extending from the base at the first end;

a detent located on the shaft proximal to the first end of the shaft and extending around an entire circumference of the shaft, wherein the detent has an outer circumference that is smaller than an outer circumference of the shaft; and a substantially triangular shaped concave surface located proximate the second end of the shaft and made of a same solid material as the shaft, wherein the concave surface extends along an axis that is angled about 45 degrees from the central axis of the shaft and is configured for blending lipstick; and a cap that is configured to fit securely around the entire shaft and couple directly to the shaft;

wherein the device is configured such that the user's lips grip the shaft at the detent, where the detent is configured to remove excess lipstick from the user's lips.

2. The device of claim 1, wherein the shaft is from 1 inch to 4 inches long.

3. The device of claim 1, wherein the shaft is from 0.5 inch to 1.5 inches long.

4. The device of claim 1, wherein the base comprises an outer diameter greater than an outer diameter of the shaft, and wherein the base is configured to be held by a person's hand.

5. The device of claim 1, wherein the concave surface comprises a depression in a surface with circumferential edges that are higher than the depression.

6. A device for removing lipstick, comprising:

a base having a substantially triangular outer shape;

a shaft extending along a central axis between a first and a second end, the shaft directly extending from the base at the first end;

a detent located on the shaft proximal to the first end of the shaft and extending around an entire circumference of the shaft, wherein the detent has an outer circumference that is smaller than an outer circumference of the shaft; and a substantially triangular shaped concave surface located proximate the second end of the shaft and made of a same solid material as the shaft, wherein the concave surface extends along an axis that is angled about 45 degrees from the central axis of the shaft and is configured for blending lipstick; and a raised ring extending around the first end of the shaft adjacent to the base; and a cap that is configured to fit securely around the shaft and removably couple to the raised ring;

wherein the device is configured such that the user's lips grip the shaft at the detent, where the detent is configured to remove excess lipstick from the user's lips.

7. The device of claim 6, wherein the shaft is from 1 inch to 4 inches long.

8. The device of claim 6, wherein the shaft is from 0.5 inch to 1.5 inches long.

9. The device of claim 6, wherein the base comprises an outer diameter greater than an outer diameter of the shaft, and wherein the base is configured to be held by a person's hand.

10. The device of claim 6, wherein when the cap is placed around the shaft, a channel in an inside surface of the cap securely accepts the raised ring extending around the shaft.

* * * * *